US005850671A

United States Patent [19]

Käser

[11] Patent Number: 5,850,671

[45] Date of Patent: Dec. 22, 1998

[54] DOOR CLOSER

[75] Inventor: Uwe Käser, Wiernsheim, Germany

[73] Assignee: GEZE GmbH & Co., Germany

[21] Appl. No.: 959,737

[22] Filed: Oct. 28, 1997

Related U.S. Application Data

[63] Continuation of Ser. No. 712,344, Sep. 11, 1996, abandoned.

[30] Foreign Application Priority Data

Mar. 1, 1996 [DE] Germany ..... 196 08 023.1

[51] Int. Cl.[6] ..... E05F 1/08

[52] U.S. Cl. ..... 16/79; 16/71

[58] Field of Search ..... 16/79, 71, 49, 16/50, 62, 64, 378, DIG. 9, DIG. 17

[56] References Cited

U.S. PATENT DOCUMENTS

| | | | |
|---|---|---|---|
| 3,561,036 | 2/1971 | Crane . | |
| 3,911,527 | 10/1975 | Lasier | 16/64 |
| 4,115,897 | 9/1978 | Zunkel | 16/49 |
| 4,378,612 | 4/1983 | Beers | 16/49 |
| 4,580,365 | 4/1986 | Sieg | 16/49 |
| 4,590,639 | 5/1986 | Fritsche et al. | 16/79 |
| 4,744,125 | 5/1988 | Scheck et al. | 16/62 |
| 4,763,385 | 8/1988 | Furch et al. | 16/62 |
| 4,999,872 | 3/1991 | Jentsch | 16/62 |
| 5,259,090 | 11/1993 | Fayngersh | 16/62 |
| 5,343,593 | 9/1994 | Fayngersh | 16/62 |

FOREIGN PATENT DOCUMENTS

| | | | |
|---|---|---|---|
| 391 512 B | 10/1990 | Austria . | |
| 28 44 302 | 4/1979 | Germany . | |
| 32 03 390 A1 | 8/1983 | Germany . | |
| 34 23 242 C1 | 11/1985 | Germany . | |
| 4237179 A1 | 5/1994 | Germany | 16/49 |
| 9200088 | 6/1993 | Sweden . | |
| 545720 | 6/1942 | United Kingdom . | |

*Primary Examiner*—Chuck Y. Mah

*Attorney, Agent, or Firm*—Evenson, McKeown, Edwards & Lenahan, P.L.L.C.

[57] ABSTRACT

A hydraulically damped door closer is described which has a relatively weak closer spring (3*c*) and stronger back-up closer springs (3*a*, 3*b*). If, after a predetermined time period, the door does not arrive in the closed position under the effect of the closer spring (3*c*), the back-up closer springs (3*a*, 3*b*) are connected for the closing. Their connection is therefore controlled by way of a time function element, which represents a simple and, at the same time, reliable control.

21 Claims, 6 Drawing Sheets

DOOR CLOSER

This application is a continuation of application Ser. No. 08/712,344, filed on Sep. 11, 1996 now abandoned.

BACKGROUND AND SUMMARY OF THE INVENTION

This invention relates to a hydraulic door closer.

Conventional hydraulic or pneumatic door closers are known as floor-concealed door closers, for example, from German Patent Document DE-OS 25 35 244, or as overhead door closers, for example, from German Patent Document DE-OS 28 19 334. These door closers have a closer spring as the energy accumulator. In this case, it is a disadvantage that, during the opening, the closer spring in each case counteracts the door and an increased expenditure of force is therefore required for the opening. In addition, relatively strong closer springs are frequently required in practice in order to ensure a secure closing of the door in an emergency, for example, in the case of fire protection doors.

A door closer of the initially mentioned type, which has an energy accumulator composed of two closer springs, of which the first partial energy accumulator is used for the closing in the normal operation and the second energy accumulator is connected only when required, is known from German Patent Document DE-PS 42 37 179. This is a hydraulic door closer with two closer springs, in which case only the weaker closer spring is operative in the normal operation and the stronger closer spring is locked by way of an electric detent device and is connected only in an emergency by way of a fire alarm system, fire detector, or the like. However, this means that, when wind pressure or another obstacle occurs in the closing path of the door, a complete closing is not ensured as long as the electric detent device is switched on.

From German Patent Documents DE-OS 28 44 302 and DE-OS 27 51 859, so-called free-swing closers are known. These are hydraulic door closers whose closer spring is held in a prestressed condition in the normal operation and is connected only in an emergency, for example, in the case of fire. These door closers are operative only in the respective emergency. In the normal operation, there is no closing effect.

From German Patent Documents DE-OS 32 34 319 and DE-OS 34 23 242, so-called servo door closers are known. These are hydraulic door closers with a closer spring and an electric motor for prestressing the closer spring during the opening. As a result of the prestressing of the closer spring by the electric motor, the opening resistance of the door during the manual operation is eliminated or at least reduced. The closing operation will then take place automatically as in the case of a conventional hydraulic door closer under the effect of the closer spring. During each opening operation, the closer spring must again be prestressed by the electric motor in order to obtain the servo effect. It is a disadvantage of these servo door closers that separate energy is required and the construction is relatively complex.

It is an object of the invention to further develop a door closer of the initially mentioned type which has a low opening resistance in the normal operation and ensures a complete closing of the door also without separate energy or a high-expenditure sensor device.

This object is achieved by the door closer according to the invention, in which, by means of the time function element, a simple control of the discharge of the second partial energy accumulator is permitted at reasonable cost. By providing a time-controlled discharge of the second partial energy accumulator, additional energy for the closing of the door is provided in a reliable manner. The second partial energy accumulator represents a back-up energy accumulator. The time function element ensures that the second partial energy accumulator becomes automatically operative for the secure closing of the door if the door does not reach the closed position within a certain time. Sensor devices which cause the connection of the second partial energy accumulator are not required.

The time function element is preferably adjustable or programmable.

The time function element may be arranged in an overflow device in a piston-cylinder unit and may be determined by the flow resistance of the overflow device. The piston-cylinder unit may have the first and the second partial energy accumulator. The partial energy accumulators may be formed by pistons which are connected behind one another and are tightly guided in a cylinder. A preferably adjustable flow control valve may be used as a time function element of the overflow device.

In addition or as an alternative, an overflow duct or an overflow groove can be arranged in the cylinder or in the piston. As a function of the position of the piston of the second partial energy accumulator, a different resistor can be switched in the flow device or different overflow devices with a different resistor can successively become operative, for example, in that successively an overflow groove becomes operative as a short-circuit groove; then an overflow strip with an adjustable flow control valve becomes operative; and finally an overflow groove again becomes operative as a short-circuit groove. Instead of the short-circuit grooves, short-circuit ducts may also be provided.

It is therefore possible that the discharge of the second partial energy accumulator has consecutive discharge phases of a different discharge speed. It can thus be implemented that the time-delayed discharge of the second partial energy accumulator, for example, at first takes place very slowly and if, after a certain time, the door has not yet reached its end position, the discharge speed will be increased and thus the second partial energy accumulator will contribute more to the closing in this phase. Preferably, three phases can take place consecutively; specifically, a first phase in which the second partial energy accumulator is used for providing a strong force for the initial fast acceleration of the door during the closing; a second phase in which the second partial energy accumulator is discharged only relatively slowly and contributes little to the closing; and if, after a certain time period, the door has not yet reached the closed position, a third phase takes place in which the second partial energy accumulator is discharged rapidly and the door closes.

In a meaningful manner, the first partial energy accumulator stores less energy than the second energy accumulator which, by means of the time-dependent control, if required, becomes operative in a time-delayed manner for the closing.

Constructively particularly simple solutions are obtained if closer springs, preferably compression springs, are provided as partial energy accumulators. The springs can be arranged in the cylinder of a pneumatic or hydraulic piston-cylinder unit and can interact with the pistons which are guided in the cylinder in a tight manner.

Other objects, advantages and novel features of the present invention will become apparent from the following detailed description of the invention when considered in conjunction with the accompanying drawings.

DETAILED DESCRIPTION OF THE DRAWINGS

Figure 1:
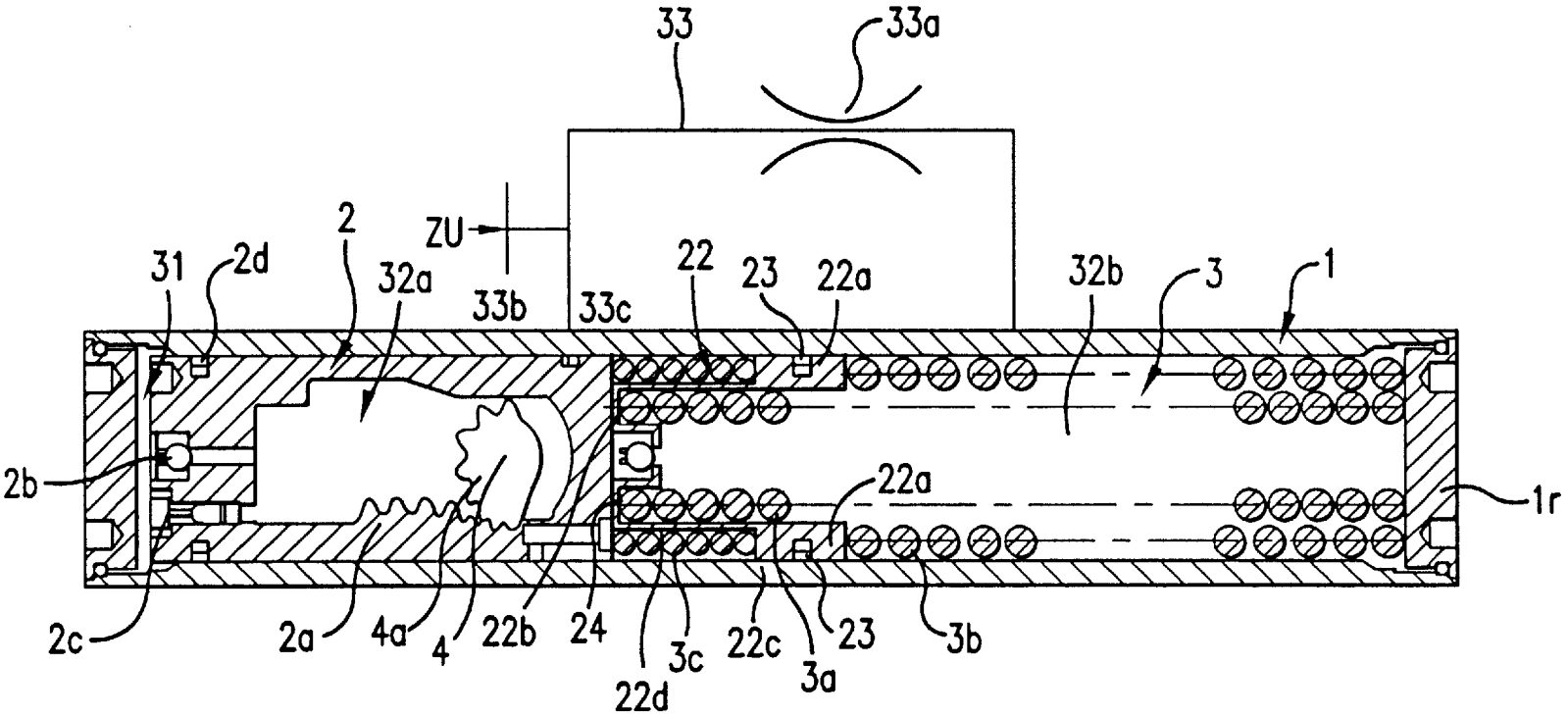
FIG. 1 is a schematic sectional view of a door closer in the operating position before the first closing while the door is closed.
Figure 2:
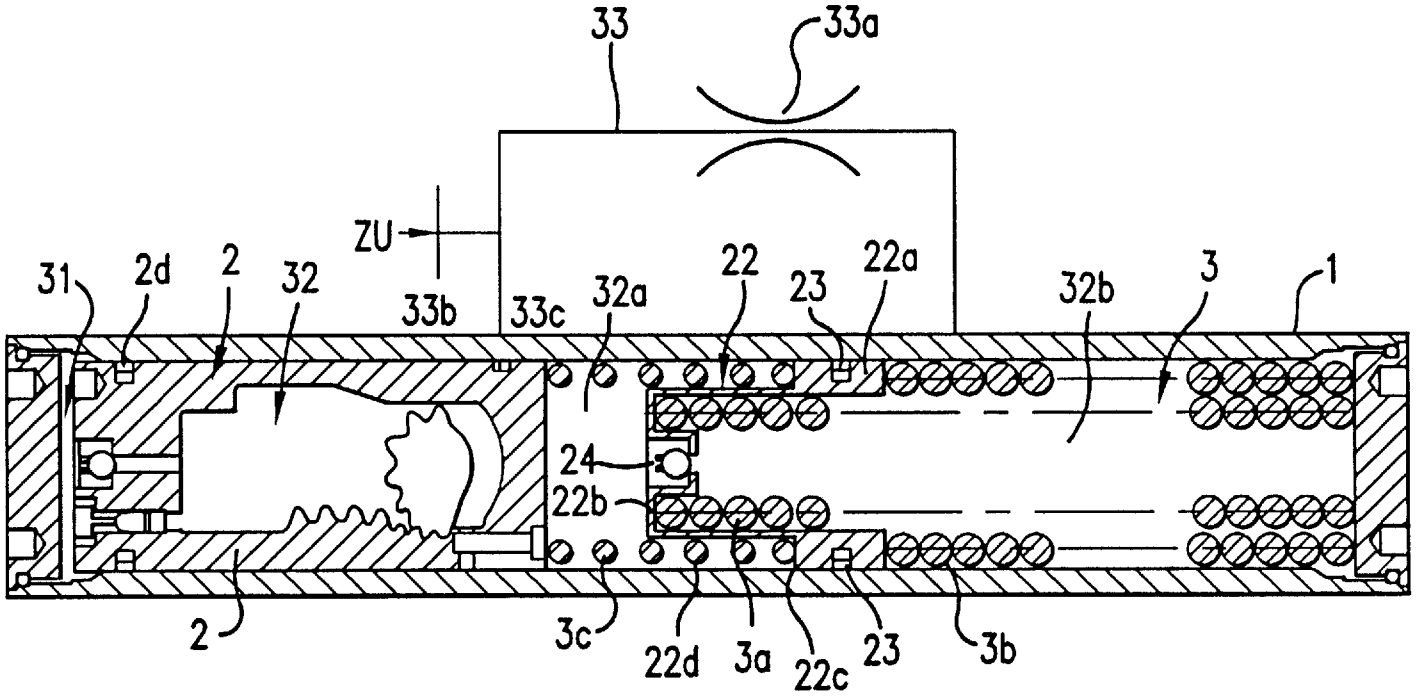
FIG. 2 is a representation corresponding to FIG. 1, in which the door closer is shown in the normal operating position while the door is closed and while the back-up closing spring is locked.
Figure 3:
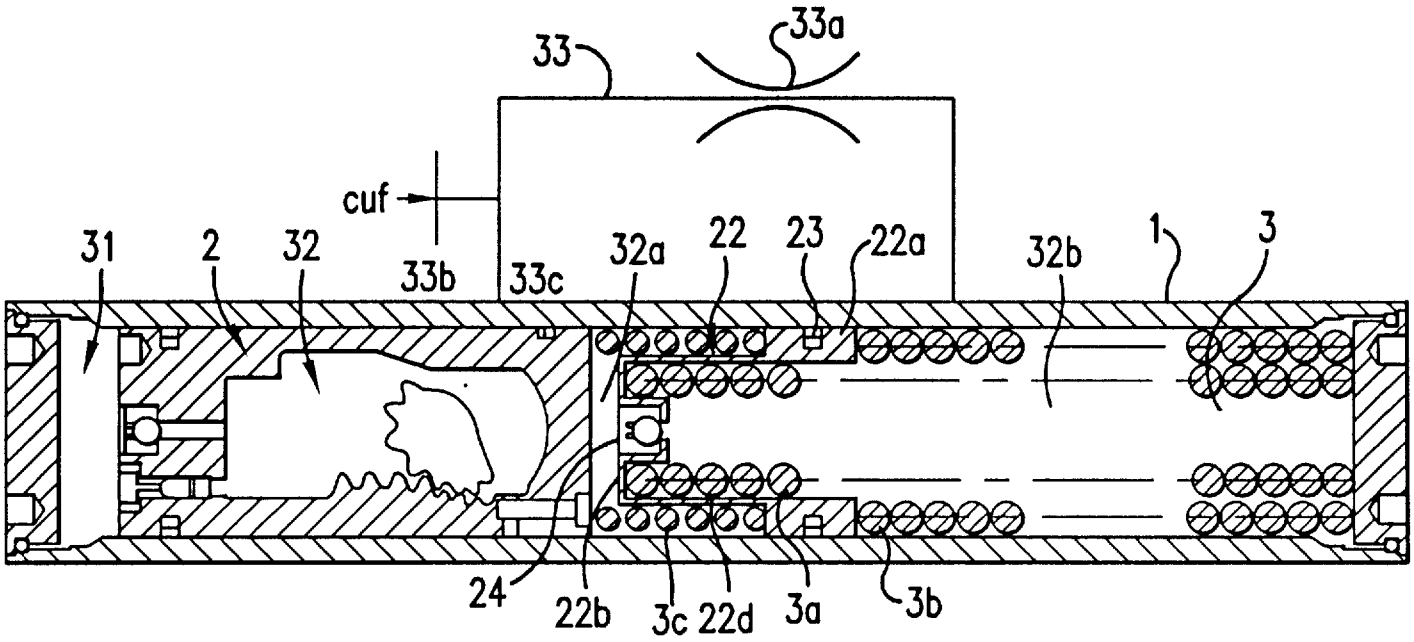
FIG. 3 is a representation corresponding to FIG. 2, in which the door closer is also shown in the normal operating position but while the door is not completely closed and while the back-up closing spring follows.

The door closing mechanism illustrated in FIGS. 1 to 3 has a housing 1 in which a hydraulically damped piston 2, an auxiliary piston 22 and a spring arrangement 3 are situated in a cylindrical bore.

The piston 2 is connected with a closer shaft 4 rotatably disposed in the housing 1 by way of a transmission, in the illustrated case, by way of a pinion gear. The pinion gear consists of a pinion non-rotatably connected with the closer shaft 4 and of a toothed rack 2*a* fixed to the piston. During the opening movement of the door, the pinion 4*a* on the closer shaft rotates counterclockwise in the representation of the figures. In this case, the piston 2 is moved toward the right. During the closing movement of the door, the movement takes place in the reverse direction; that is, the pinion 4*a* on the closer shaft 4 rotates clockwise and the piston 2 is moved toward the left.

The closing spring device 3 consists of a closing spring 3*c* and two back-up closing springs 3*a*, 3*b* all of which are concentrically arranged compression springs. By means of its left end, the closing spring 3*c* is supported directly on the right front side of the piston 2 and by means of its right end, it is supported on an auxiliary piston 22. The auxiliary piston 22 is accommodated in the cylinder space on the right by the piston 1 and is also slidably guided as a hydraulic piston in the cylinder space. The back-up closing springs 3*a*, 3*b* are each supported by means of their left end on the auxiliary piston 22 and by means of their right end on the right front end of the housing 1 on a housing lid 1*r* screwed in there.

The auxiliary piston 22 is constructed in the shape of a pot and consists of a tube-shaped piston shell 22*a* as well as of a piston bottom 22*b*. The piston shell and the piston bottom may consist of one piece (FIG. 1 to 4); or, as illustrated, for example, in FIG. 5 and 6, of two pieces which are connected with one another in a pressure-sealed manner, for example, by means of a glued or welded connection. For simplifying the machining, the diameter of the piston shell 22*a* can be designed to be smaller at the piston-bottom-side end of the piston 22 than in the area in which the piston shell takes over the axial guiding in the piston.

There are several possibilities for arranging the spring elements 3 together with the auxiliary piston 22: In FIGS. 1 to 3, the interior back-up closing spring 3*a* is concentrically accommodated in the piston interior. The left end of the spring 3*a* is supported on the piston bottom 22*b*. It projects out of the piston toward the right and is supported on the housing lid 1*r* by means of its right end. The second back-up closing spring 3*b* is arranged concentrically to the spring 3*a*. It is supported by means of its left end on the end face of the piston shell 22*a*; and it is supported by means of its right end on the housing lid 1*r*. The guiding of the auxiliary piston 22 in the cylinder takes place by way of the piston shell 22*a* whose left end is formed by the collar 22*c*. On the left of the collar 22*c*, the outside diameter of the piston 22 tapers to form the exterior jacket 22*d* of the piston. The closing spring 3*c* is arranged concentrically with respect to the exterior jacket 22*d* of the piston. Its right end is supported on the collar 22*c*; and its left end is supported on the right face of the piston 2. The sealing element 23 which seals off the hydraulic space 32*a* with respect to the hydraulic space 32*b* is situated in the piston shell 22*a*.

Figure 4:
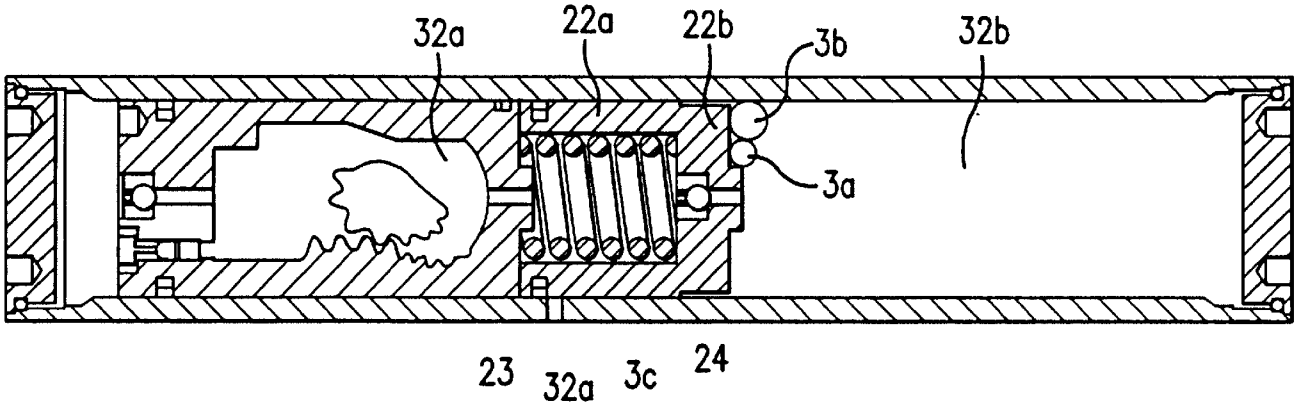
FIG. 4 is a representation corresponding to FIG. 3, in which another variant of the arrangement of the auxiliary piston and of the back-up closing springs is shown.
Figure 5:
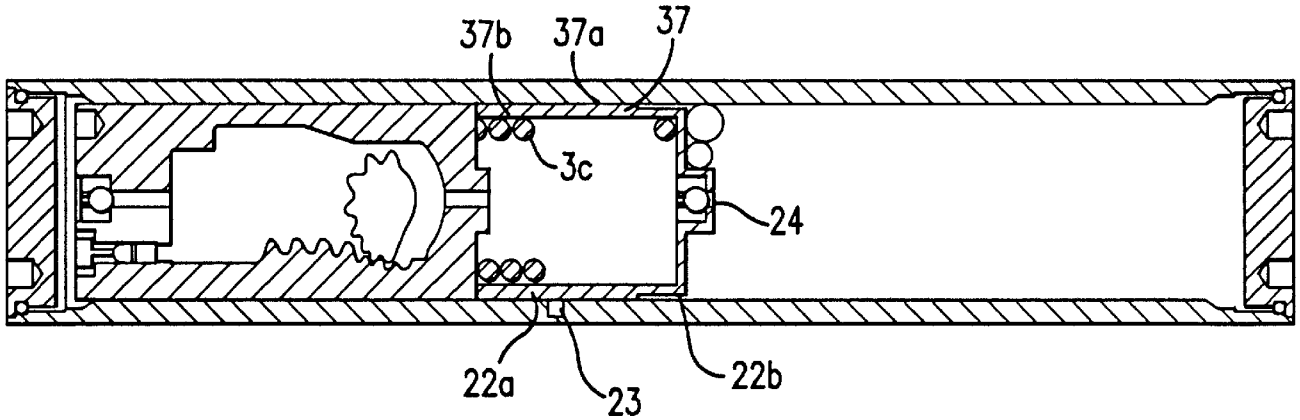
FIG. 5 is a representation corresponding to FIG. 1 with a variant of the auxiliary piston and of a sealing element mounted in the cylinder wall.
Figure 6:
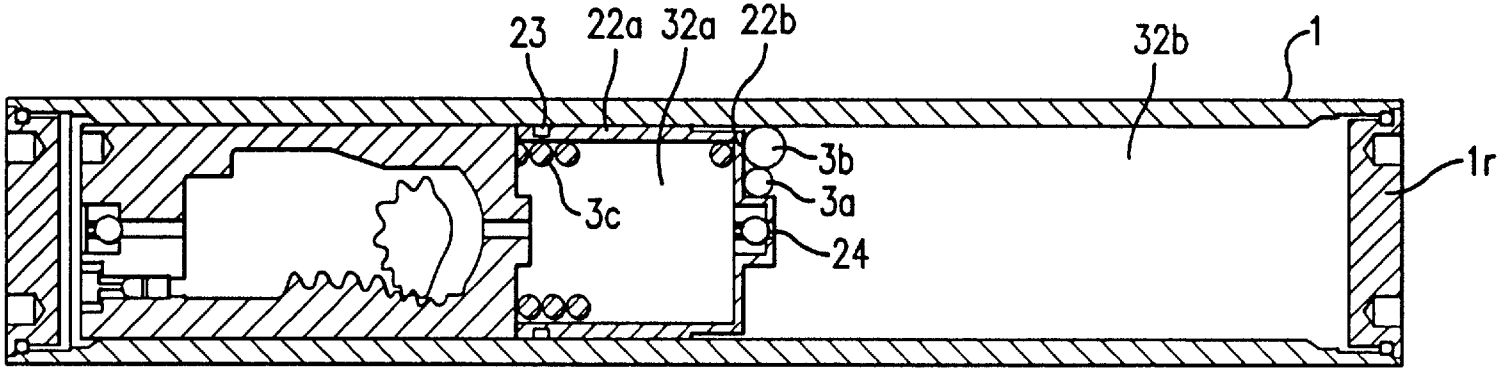
FIG. 6 is a representation corresponding to FIG. 5 with a sealing element mounted in the piston shell.

Another variant of the arrangement of the spring elements 3 and of the auxiliary piston 22 is illustrated in FIGS. 4 to 6: In comparison to FIGS. 1 to 3, the auxiliary piston is rotated by 180° so that the piston bottom 22*b* points toward the right. The concentric back-up springs 3*a* and 3*b* are supported at their left ends on the piston bottom; while their right ends are supported on the housing lid 1*r*. The closing spring 3*c* is mounted in the interior of the auxiliary piston 22 in a concentric manner thereto. Its right end is supported from the interior on the piston bottom 22*b*; its left end is supported on the right face of the piston 2. In comparison to the arrangement in FIGS. 1 to 3, this arrangement has the advantage that the sealing element 23 arranged in the piston shell 22*a* is moved only over a cylinder surface which cannot come in contact with the closing spring 3*c*. In FIGS. 1 to 3, the closing spring 3*c* could damage the cylinder wall surface and thus impair the operability of the sealing element 23.

The cylinder interior and the interior of the pistons 2 and 22 are filled with hydraulic oil (FIGS. 1 to 6). The piston 2 has a sealing element 2*d* (preferably made of an elastomer material) and divides the cylinder space into a hydraulic space 31 on the left of the sealing element 2*d* and a hydraulic space 32 on the right of the sealing element. The hydraulic space 32, in turn, is divided by the sealing element (preferably made of an elastomer material) into a space which accommodates the closing spring 3*c*, and a space 32*b* which accommodates the back-up springs 3*a* and 3*b*. As a function of the used springs 3, different pressures exist in the hydraulic spaces, in which case the following applies: Pressure $P_1$ (in space 31)>pressure $P_2$ (in space 32*a*)>pressure $P_3$ (in space 32*b*). The hydraulic space 31 is connected with the hydraulic space 32 by way of hydraulic ducts 36 (FIG. 8) which contain flow control valves for controlling the closing and opening speed, as known in the case of conventional door closers.

In addition, a spring-loaded check valve 2*b* is arranged in the left face of the piston 2, which check valve 2*b* opens up during the opening movement when, in the representation of the figures, the piston 2 is moved to the right. In addition, as also known per se, a pressure control valve 2*c* is arranged in the piston 2.

Either, as illustrated in FIGS. 1 to 4, the sealing element 23 can be mounted in the piston shell 22*a* or, as illustrated in FIG. 5, it can be mounted at a suitable point in the cylinder bore.

For the hydraulic control of the auxiliary piston 22, an overflow duct 33 connects the hydraulic spaces 32*a* and 32*b*. The overflow duct contains a throttle, preferably an adjustable control valve 33*a*, by means of which the flow rate of the hydraulic fluid through the duct and thus the moving speed of the auxiliary piston can be adjusted. A stop valve 33*b* in the overflow duct is closed when, during the closing operation, the door has reached its end position. In addition, a spring-loaded check valve 24 is provided in the piston bottom 22*b* of the auxiliary piston, which check valve 24 opens up for the flowing of the hydraulic fluid from space 32*b* into space 32*a* when the auxiliary piston 22 is moved to the right.

When the illustrated door closer operates as follows. The door is opened manually, the closer shaft rotates with the pinion 4*a* counterclockwise and the piston 2 is forcibly displaced toward the right against the effect of the closing spring device 3. In this case, the auxiliary piston 22 resting against the piston 1 is taken from the initial position in FIG. 1 toward the right and the back-up closing springs 3*a*, 3*b* are compressed. The closing spring 3*c* which is installed in a prestressed position and preferably can be blocked, in this case, remains in its prestressed position.

During the displacement of the auxiliary piston 22 toward the right, the check valve 24 opens up so that the hydraulic oil displaced by the piston movement can flow from space 32*b* into space 32*a*. When the door is opened completely, for example, 180°, the piston 2 and the auxiliary piston 22 each reach the right end position in which the back-up closing springs 3*a*, 3*b* are maximally compressed.

Figure 7:
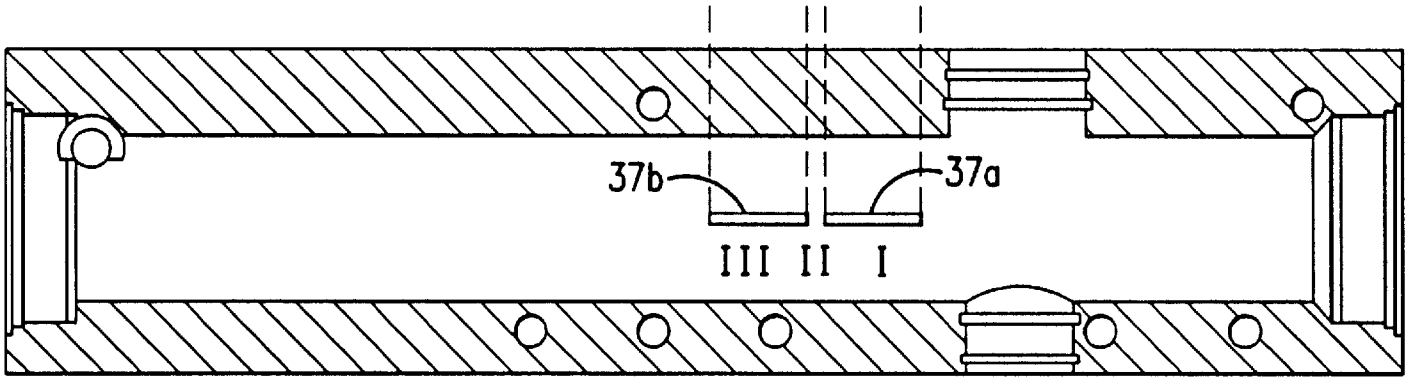
FIG. 7 is a representation of the overflow grooves in the cylinder wall.

The closing operation will then take place automatically under the effect of the closing spring device 3. At the start of the closing operation (for example, in the case of an angular position of the door between 180° and 80°), the door is to be accelerated without interruption and with a higher force. This fast-moving phase I lasts, for example, 2 seconds. During this phase, the hydraulic space 32*b* is connected with the hydraulic space 32*a* by means of the groove 37*a* (FIG. 7) which causes a hydraulic short circuit. As a result, the hydraulic fluid can flow from space 32*a* into space 32*b*, and the back-up closing springs 3*a*, 3*b* move the auxiliary piston toward the left at a high force. The movement of the auxiliary piston is transmitted by way of the closing spring 3*c* to the main piston, pressing it toward the left. The closer shaft 4 is rotated by means of the movement of the piston 2.

During the slow-moving phase of the door (for example, at an angular position of between 80° and 45°), the auxiliary piston 22 moves in a slow-moving phase II very slowly toward the left as a result of the force of the back-up closing springs 3*a*, 3*b*. During this phase, the sealing element 23 in the auxiliary piston 22 is situated on the web between the groove 37*a* and the groove 37*b* so that the hydraulic fluid displaced by the movement of the auxiliary piston 22 can now travel from hydraulic space 32*a* into hydraulic space 32*b* only through the overflow duct 33.

During the slow-moving phase of the auxiliary piston 22, the piston 2 moves essentially under the effect of the relatively weak closing spring 3*c*. This means that the piston 2 advances in front of the auxiliary piston in an accelerated or faster manner.

In the slow-moving phase II, the moving speed of the auxiliary piston is damped by the control valve 33*a* situated in the overflow duct 33. This speed can be adjusted by means of the control valve. This control valve is adjusted, for example, such that the whole slow-moving phase II of the auxiliary piston 22 amounts to approximately 25 sec.

The stop valve 33*b* is open when the door is open. As soon as the piston 2 reaches its left end position when the door is closed, the stop valve 33*b* in the overflow duct 33 is closed by way of a corresponding mechanism. As a result, the auxiliary piston 22 is fixed in its momentary position and the residual energy stored in the back-up springs 3*a*, 3*b* is maintained. This means that the slow-moving phase as a rule is stopped prematurely.

However, if the door has not reached its closed position prior to expiration of the slow moving Phase II (for example, because of an increased wind pressure), the overflow duct 33 remains open. The auxiliary piston 22 advances slowly, for example, to a door angle position of 45°, as of which the sealing element 23 is above the groove 37*b*. As in the fast-moving phase I, a hydraulic short circuit will occur again between the hydraulic spaces 32*b* and 32*a*, and the residual energy stored in the back-up springs 3*a* and 3*b* is utilized for closing the door in addition to the energy of the spring 3*c*. In this fast-moving phase III, the weaker closing spring 3*c* is compressed simultaneously and the starting position of the door closer is obtained again which is illustrated in FIG. 1.

Another possibility for controlling the movement of the auxiliary piston 22 is illustrated in FIG. 5. Here, the sealing element 23 is situated at a corresponding point in the cylinder bore and the grooves 37*a*, 37*b* are mounted in the piston shell 22*a* of the auxiliary piston 22.

Figure 8:
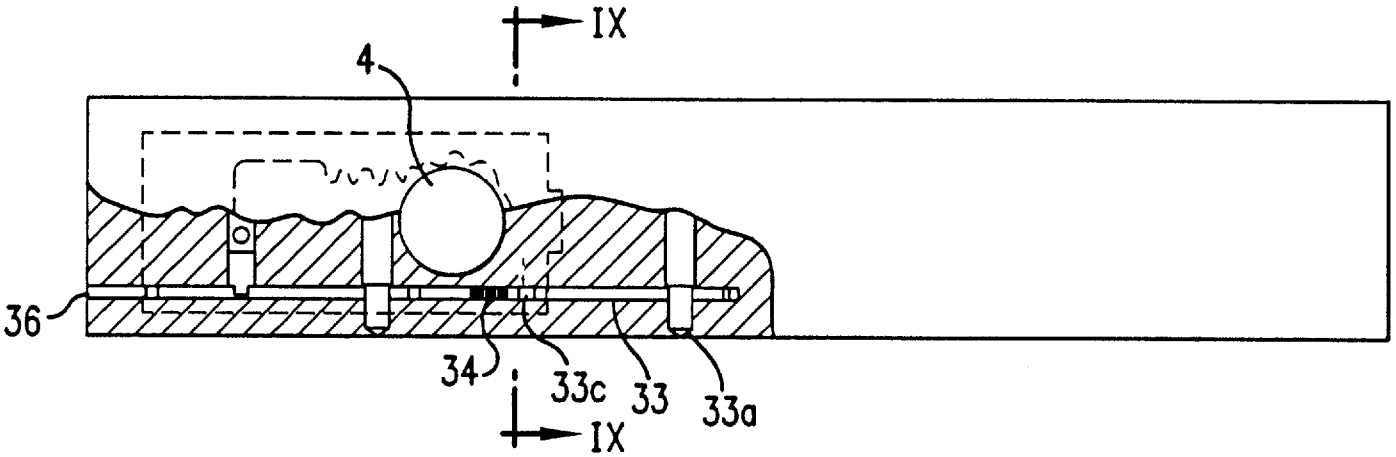
FIG. 8 is a representation of the piston and damping control.
Figure 10:
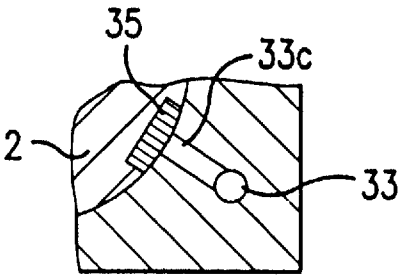
FIG. 10 is a view of a detail of FIG. 9.
Figure 9:
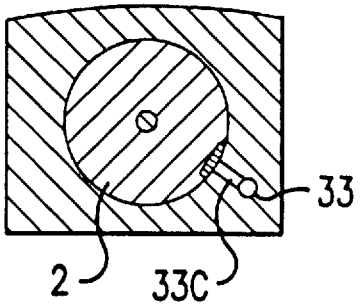
FIG. 9 is a sectional view of the piston and the housing along Line IX—IX in FIG. 8.

Another possibility for opening and closing the flow-through opening of the duct 33 is illustrated in FIGS. 8 to 10. Instead of the stop valve 33*b*, a seal 35 (preferably made of an elastomer material) exists which is embedded in the piston 2. The piston 2 is guided such that its cannot rotate about it longitudinal axis. The seal 35 is mounted such that, in the left end position of the piston 2 when the door is closed, it closes off the mouth 33*c* of the overflow duct 33 into the hydraulic space 32*a*. As a result, the overflow duct 33 is closed between the hydraulic spaces 32*b* and 32*a* and the auxiliary piston 22 is thus hydraulically blocked. In addition, the effect of the seal 35 can be promoted by a spring element placed behind it.

The overflow duct 33 can be designed such that the oblong hole bore 36 is closed at a suitable point by a plug 34. In FIG. 8, the overflow duct 33 (as part of the oblong hole bore), the mouth 33*c* and the adjustable control valve 33*a* are situated on the right of the plug. The hydraulic circulating system for the piston 2 for the control of the end stop and of the closing time is situated on the left of the plug 34.

In another embodiment, the closing of the overflow duct mouth 33*c* takes place by means of the sealing element 2*d* embedded in the piston 2. The overflow duct mouth 33*c* will then be situated on the sealing element 2*d* in the closed position of the piston 2.

If the back-up springs 3*a*, 3*b* were not completely discharged during the closing, but, as described above, were hydraulically blocked during the closing, they affect, as opening dampers, a last degree of the opening angle of the door during the subsequent opening. The swinging energy of the door can then recharge the already prestressed back-up energy accumulators which simultaneously dampens the opening movement of the door and signals to the user the end of the door opening angle by an increased opening resistance.

Since a particularly high operating pressure (approximately 50 bar) exists in the hydraulic space 32, a special sealing of the drive shaft 4 is required in the housing 1 in order to prevent that hydraulic oil leaks out of the housing.

When the door is opened again, the opening resistance must therefore only be overcome which is generated by the tension of the closing spring 3*c*. Only in the case of a progressing opening angle, when the piston 2 comes to rest against the auxiliary piston 22, does the opening resistance of the back-up closing springs 3*a*, 3*b* will occur. As a result, an opening damping is obtained which is desirable in the case of large door opening angles.

In the illustrated embodiment, the closing spring 3*c* has a weaker construction than the sum of the back-up closing springs 3*a*, 3*b* switched in parallel.

The closing spring 3*c* is designed such that, during the normal operation, when no special closing resistance exists, for example, in the form of wind pressure or obstacles in the closing path, it is capable of completely closing the door, that is, displacing the piston 2 in its left end position before the auxiliary piston 22 has completely passed through its slow-moving phase II and thus before the back-up energy accumulator with the back-up spring 3*a*, 3*b* is significantly discharged.

This is therefore a hydraulically damped door closer which has a relatively weak closer spring 3*c* and stronger back-up closer springs 3*a*, 3*b*. If, after a predetermined time, the door does not reach its closed position under the effect of the closer spring 3*c*, the back-up closing springs 3*a*, 3*b* are connected for the closing. Their connection is therefore controlled by a time function element, which represents a simple and reliable control.

I claim:

1. Door closer for a door having a door closure, comprising:

an energy accumulator for closing the door closure, the energy accumulator being at least partially charged by manual opening of the door closure, and being at least partially discharged to effect closing of the door closure;

the energy accumulator comprising a first partial energy accumulator and a second partial energy accumulator, door closing taking place by discharge of the first partial energy accumulator, and the second partial energy accumulator; and a time function means for controlling discharge of the second partial energy accumulator whereby it is ensured that, after the opening, the door closes completely within a predetermined time, said time function means including means for automatically initiating discharge of the second partial energy accumulator if the closed position is not reached within a predetermined time period, and for automatically stopping discharge of the second partial energy accumulator as soon as a closed position is reached; and means for controlling discharge of the second partial energy accumulator such that during the closing operation, the second partial energy accumulator discharges continuously but more slowly than the first partial energy accumulator, with discharge phases of a different discharge speed.

2. Door closer according to claim 1, wherein said time function means includes means for adjusting the predetermined time period.

3. Door closer according to claim 2, wherein a last discharge phase of the second partial energy accumulator, preceding the closed position, has a relatively higher discharge speed in comparison to a discharge speed of the first partial energy accumulator and in comparison to a discharge speed of the second partial energy accumulator at least in a discharge phase which precedes the last discharge phase.

4. Door closer according to claim 3, wherein the last discharge phase of the second partial energy accumulator, follows a second discharge phase with a relatively slow discharge speed.

5. Door closer according to claim 4, wherein before the second discharge phase of the second partial energy accumulator taking place at a relatively slow discharge speed first discharge phase takes place which has a relatively high discharge speed.

6. Door closer according to claim 5, wherein:

the first partial energy accumulator comprises a first piston guided in a tight manner in a common cylinder;

the second partial energy accumulator comprises a second piston which is guided tightly in the common cylinder; and the first piston and the second piston are connected behind one another.

7. Door closer according to claim 6, wherein said time function means includes means for controlling the second piston pneumatically or hydraulically.

8. Door closer according to claim 7 wherein:

the time function means comprises an overflow device which connects a cylinder space formed in front of the second piston with a cylinder space formed behind the second piston;

the time function means has at least one of an adjustable flow control valves, an overflow duct, and an overflow groove in the cylinder or in the second piston.

9. Door closer according to claim 8, wherein, a flow resistance in the overflow device varies as a function of a position of the second piston, whereby different resistances become operative successively.

10. Door closer according to claim 9 wherein a moving speed of the second piston is controlled by an overflow groove which is formed in one of an exterior piston wall and the interior wall of the cylinder.

11. Door closer according to claim 10 wherein the moving speed of the second piston is controlled by an overflow duct which is constructed in the cylinder or in the piston.

12. Door closer according to claim 11 wherein one of a control valve and a stop device is arranged in the overflow duct.

13. Door closer according to claim 12 when one of the closed position of the door and a predetermined position of the first piston is reached, the stop valve stops movement of the second piston automatically, storing the residual energy of the second partial energy accumulator for a subsequent closing operation.

14. Door closer according to claim 13 wherein a mouth of the overflow duct is closed by the first piston as soon as the closed position of the door is reached.

15. Door closer according to claim 14 wherein the first piston has a seal which interacts with the mouth of the overflow duct in the cylinder said seal comprising a spring-loaded sealing element, arranged in a recess in the first piston.

16. Door closer according to claim 7 wherein:

the first piston and the second piston form hydraulic spaces in the cylinder, which are hydraulically connected with one another such that a different hydraulic pressure is generated in the spaces, a first space being formed in front of the first piston, a second space being formed between the first piston and the second piston, and a third space being formed behind the second piston; and during closing, a higher pressure is generated in the first space than in the second space, and in the second space a higher pressure is generated than in the third space.

17. Door closer according to claim 16, wherein an output shaft interacts with the first piston by way of a pinion gear with a piston-side toothed rack and an output-shaft-side pinion.

18. Door closer according to claim 17 wherein the output shaft is rotatably disposed in the cylinder while sealing by means of a seal designed for hydraulic pressures treater than 10 bar.

19. Door closer according to claim 18, wherein said seal is designed for hydraulic pressures greater than 50 bar.

20. A device for automatically closing a door, comprising a first energy accumulator which is at least partially charged by a manual opening of said door; and a second energy accumulator which is at least partially charged by a manual opening of said door, both of said first and second energy accumulators being coupled to each other for discharging stored energy to close said door;

wherein said second energy accumulator includes a time delay element which delays for a predeterminable time period an application of energy stored therein to close said door.

21. The device according to claim 20 further comprising a device coupled to said second energy accumulator, which interrupts a discharge of energy from said second energy accumulator if said door reaches a closed position within said predeterminable time period.

* * * * *